US007497671B2

(12) United States Patent
Kakiuchi et al.

(10) Patent No.: US 7,497,671 B2
(45) Date of Patent: Mar. 3, 2009

(54) HERMETIC COMPRESSOR

(75) Inventors: Takashi Kakiuchi, Kanagawa (JP); Takeshi Kojima, Kanagawa (JP)

(73) Assignee: Panasonic Corporation, Osaka (JP)

( * ) Notice: Subject to any disclaimer, the term of this patent is extended or adjusted under 35 U.S.C. 154(b) by 360 days.

(21) Appl. No.: 10/524,027

(22) PCT Filed: May 18, 2004

(86) PCT No.: PCT/JP2004/007047

§ 371 (c)(1),
(2), (4) Date: Feb. 9, 2005

(87) PCT Pub. No.: WO2005/003560

PCT Pub. Date: Jan. 13, 2005

(65) Prior Publication Data

US 2006/0153710 A1 Jul. 13, 2006

(30) Foreign Application Priority Data

Jul. 4, 2003 (JP) ..... 2003-191961

(51) Int. Cl.
*F04B 35/04* (2006.01)

(52) U.S. Cl. ..... 417/415; 417/902

(58) Field of Classification Search ..... 417/415, 417/372, 902

See application file for complete search history.

(56) References Cited

U.S. PATENT DOCUMENTS

| | | | | | |
|---|---|---|---|---|---|
| 3,164,423 | A | * | 1/1965 | Hatz, Jr. et al. | 384/457 |
| 3,581,599 | A | * | 6/1971 | Lee et al. | 74/603 |
| 4,406,590 | A | * | 9/1983 | Kessler | 417/360 |
| 4,406,593 | A | * | 9/1983 | Kessler | 417/363 |
| 4,834,627 | A | * | 5/1989 | Gannaway | 417/415 |
| 5,435,702 | A | | 7/1995 | Koyama et al. | |
| 6,012,423 | A | * | 1/2000 | Fischer | 123/197.4 |
| 6,135,727 | A | * | 10/2000 | Dreiman et al. | 417/415 |
| 6,287,092 | B1 | * | 9/2001 | Calciolari et al. | 417/415 |
| 2002/0046625 | A1 | * | 4/2002 | Leith | 74/603 |

FOREIGN PATENT DOCUMENTS

| | | |
|---|---|---|
| GB | 2 315 300 | 1/1998 |
| JP | 52-139407 | 10/1977 |
| JP | 55-125374 | 9/1980 |
| JP | 2002-070744 | 3/2002 |

* cited by examiner

*Primary Examiner*—Devon C Kramer
*Assistant Examiner*—Leonard J Weinstein
(74) *Attorney, Agent, or Firm*—Wenderoth, Lind & Ponack, L.L.P.

(57) ABSTRACT

By adopting a construction in which a first balance weight is provided at the side end portion of the eccentric shaft portion of the auxiliary shaft portion and a second balance weight is provided at the side end portion of the eccentric shaft portion of the main shaft portion, it becomes possible to provide sufficient first balance weight and second balance weight, without spoiling the compact size of the compressor, thus enabling the reduction of noise and vibrations.

1 Claim, 9 Drawing Sheets

HERMETIC COMPRESSOR

This application is a U.S. National phase application of PCT International Application PCT/JP2004/007047, filed May 18, 2004.

TECHNICAL FIELD

The present invention concerns a hermetic compressor used a refrigerator, an air conditioner, a refrigeration system, etc.

BACKGROUND ART

In recent years, there has been a strong request for a reduction of power consumption and quiet operation in a freezing system, such as a freezer-refrigerator for household use, etc. Under such circumstances, use of low-viscosity lubricating oil and reduction of rotational speed of inverter-driven compressors (1200 r.p.m. or so in the case of a refrigerator for household use, for example) are gradually progressing. On the other hand, it is becoming a prerequisite to adopt hydrocarbon based refrigerant, etc. which is a natural refrigerant of low greenhouse coefficient as represented by R134a and R600a, the ozone depleting coefficient of which is zero. Moreover, the conventionally employed method of two-end bearing which supports a shaft at no less than 2 points is effective as element technology for reducing sliding loss and reducing power consumption.

An explanation will be given hereinafter of a conventional hermetic compressor described in Japanese Utility Mode Laid-open No. S52-139407, with reference to drawings.

FIG. 8 is a longitudinal sectional view of a conventional compressor. FIG. 9 is a sectional plan view of a conventional compressor.

In FIG. 8 and FIG. 9, the closed vessel 1 is filled with a refrigerant 2. The electric driving element 5 composed of a stator 3 having a coil portion 3*a* and a rotor 4, and the compressing element 6 driven by the electric driving element 5 are elastically stored in the vessel 1 by means of suspension spring 7.

The shaft 10 has (i) a spindle portion 11 to which is press fit and fixed the rotor 4, (ii) an eccentric portion 12 formed in eccentricity against the spindle portion 11, (iii) an auxiliary shaft portion 13 provided coaxially with the spindle portion 11, and (iv) a balance weight 10*a* formed integrally with the shaft 10 between the eccentric portion 12 and the auxiliary shaft portion 13. Furthermore, between the spindle portion 11 and the eccentric portion 12, a joint portion 14 is formed having a diameter smaller than that of the spindle portion 11 and the eccentric portion 12.

The cylinder block 16 has an about cylindrical compression chamber 17, and is provided with a main bearing 18 supporting the spindle portion 11. Over the cylinder block 16, an auxiliary bearing 19 is fixed for supporting the auxiliary shaft portion 13. The piston 20 is inserted, in a way so as to freely slide reciprocatingly, in the compression chamber 17 of the cylinder block 16, and is connected with the eccentric portion 12 through a connecting means 21. The small end portion 21*b* of the connecting means is connected with the piston 20 by means of a piston pin 22, while the large end portion 21*a* is connected with the eccentric portion 12.

Now an explanation will be given below of the motions of a hermetic compressor constructed as described above.

The shaft 10 turns with the rotor 4 of the electric driving element 5. As the rotational motion of the eccentric portion 12 is transferred to the piston 20 through the connecting means 21, the piston 20 makes reciprocating motions in the compression chamber 17. With this motion, the refrigerant gas is sucked from the cooling system (not illustrated) into the compression chamber 17 and compressed there, and is then discharged back into the cooling system again.

On the occasion of this compressing action, the reciprocating motion of the piston 20 produces a reciprocating inertial force which is an unbalanced force. This reciprocating inertial force is balanced by a balance weight 10*a* provided between the eccentric portion 12 and the auxiliary shaft portion 13, in a way so as to be in opposite phase against the piston 20. This offsets to some extent the reciprocating inertial force of the piston 20 in the horizontal direction.

However, with the above-described conventional construction in which a balance weight 10*a* is provided only on the upper side of the piston 20, although the unbalanced force in the horizontal direction due to reciprocating inertial force of the piston 20 can be offset, an unbalanced force remains in the axial direction of the shaft 10 which is the vertical direction. As a result, this unbalanced force makes the compressing element 6 and the electric driving element 5 vibrate, and this vibration makes the closed vessel 1 vibrate through the suspension spring 7. Namely, the vibrations of the compressor cannot be reduced sufficiently.

SUMMARY OF THE INVENTION

The objective of the present invention, realized for solving the problem of the conventional hermetic compressor, is to provide a hermetic compressor with low vibrations during operation, good workability in assembling and high reliability.

The hermetic compressor according to the present invention is provided with an electric driving element, a compressing element driven by the electric driving element, and a closed vessel for housing the electric driving element and the compressing element. The compressing element is provided with (i) a shaft having an eccentric shaft portion as well as an auxiliary shaft portion and a spindle portion provided coaxially at the top and the bottom with the eccentric shaft portion between, (ii) a cylinder block provided with a compression chamber, (iii) a main bearing provided on the cylinder block and supporting the spindle portion, (iv) an auxiliary bearing provided on the cylinder block and supporting the auxiliary shaft portion, (v) a piston reciprocating in the compression chamber, and (vi) a connecting means connecting between the piston and the eccentric shaft portion. At a side end of the eccentric shaft portion of the auxiliary shaft portion is provided a first balance weight, and at a side end of the eccentric shaft portion of the spindle portion is provided a second balance weight. And, the first balance weight is constituted with the auxiliary shaft portion and a separate member.

DETAILED DESCRIPTION OF THE PREFERRED EMBODIMENTS

An explanation will be given of a preferred embodiment of the present invention, with reference to drawings.

Preferred Embodiment 1

Figure 1:
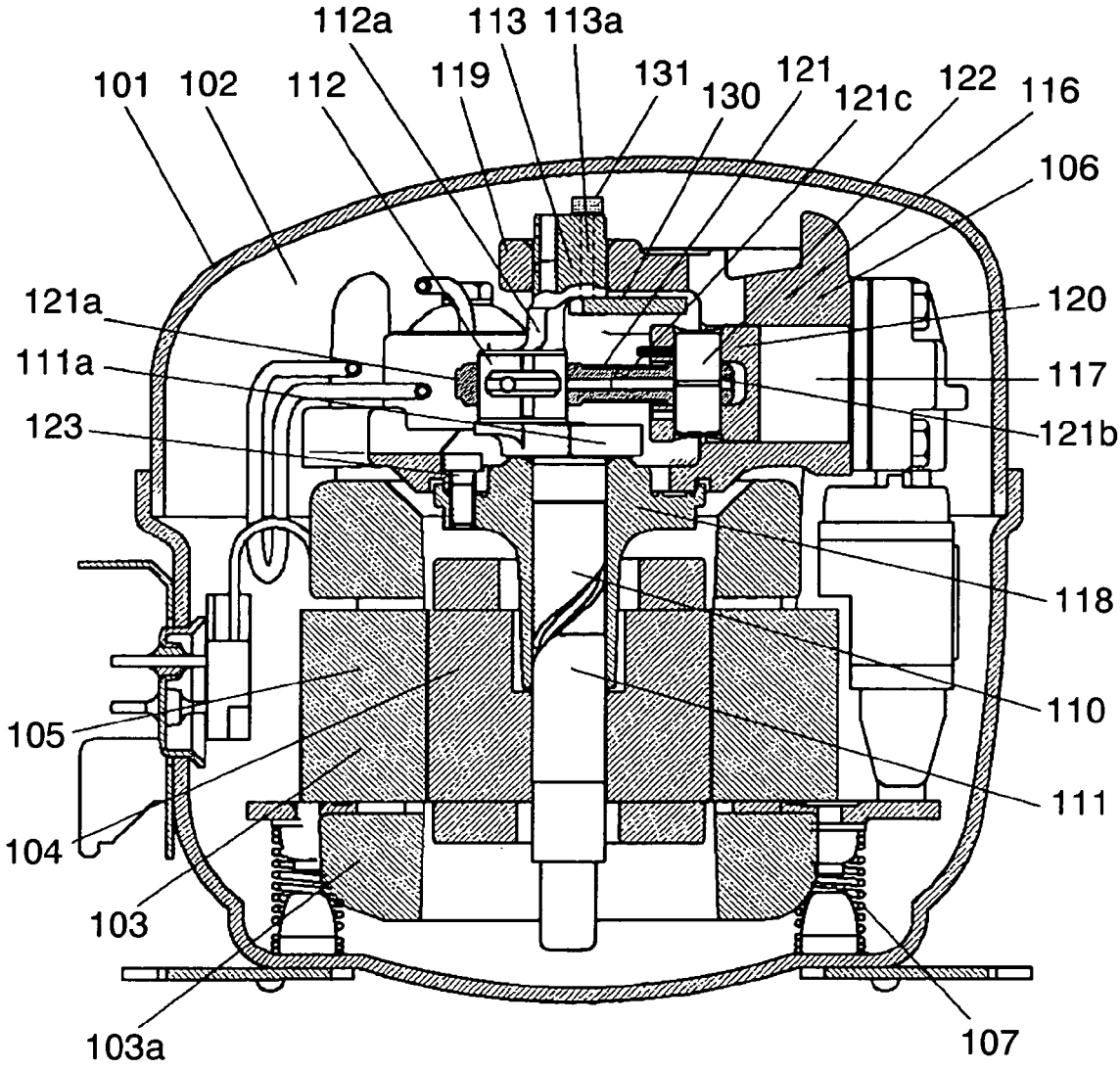
FIG. 1 is a vertical sectional view of the hermetic compressor according to preferred embodiment 1 of the present invention.
Figure 2:
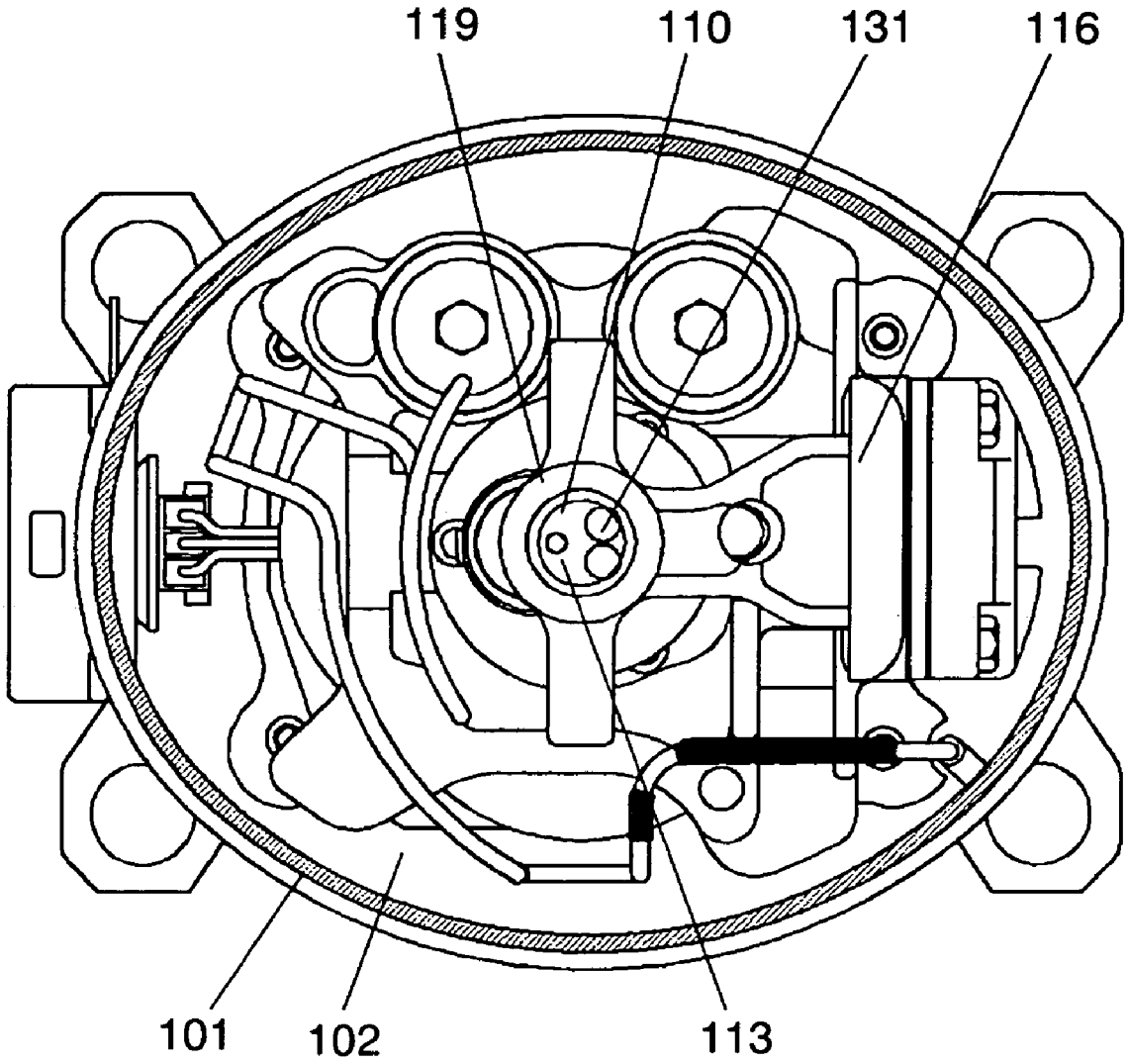
FIG. 2 is a sectional plan view of the hermetic compressor according to the embodiment 1.
Figure 3:
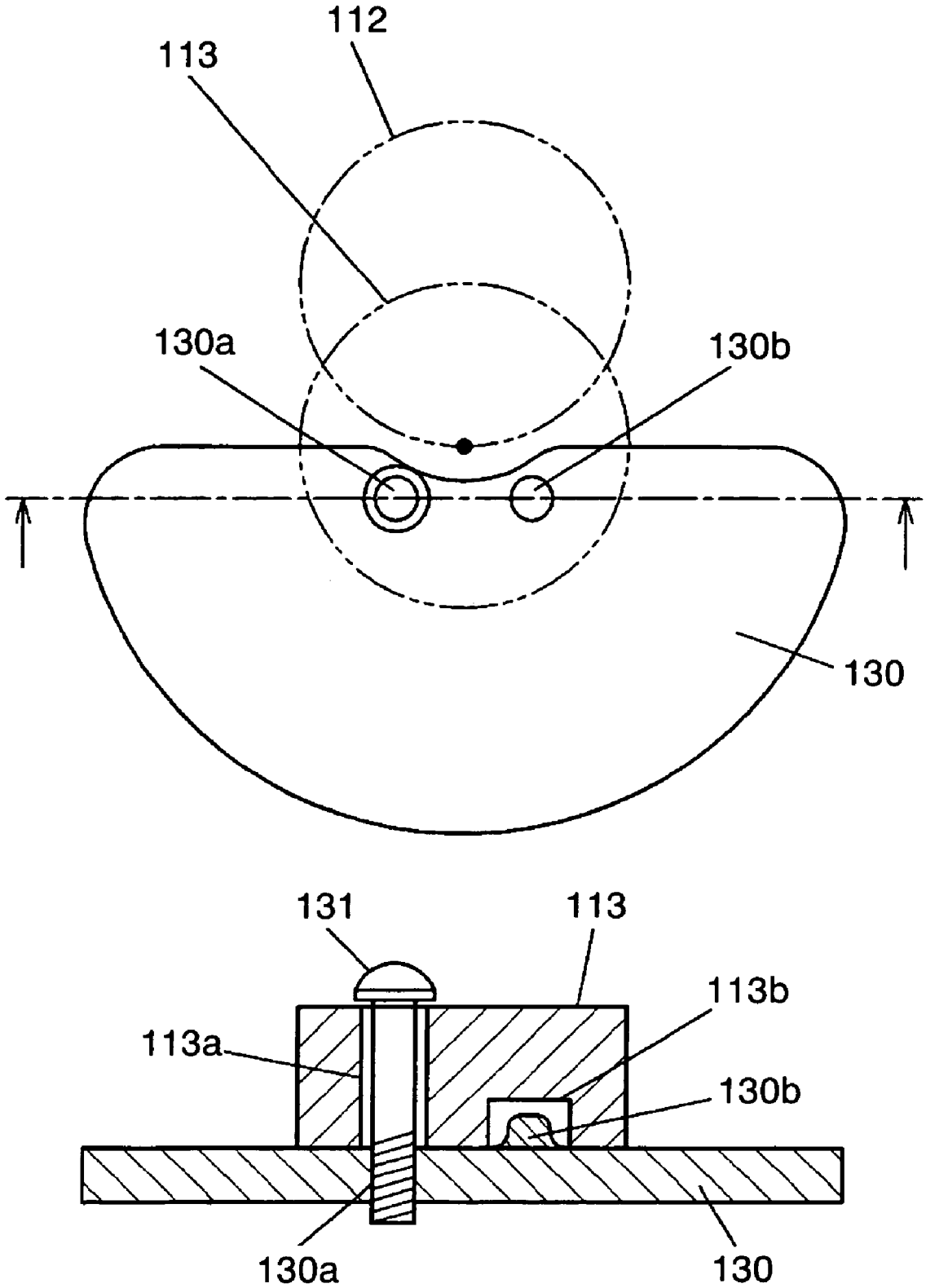
FIG. 3 is an expanded view of main part of the hermetic compressor according to the embodiment 1.
Figure 4:
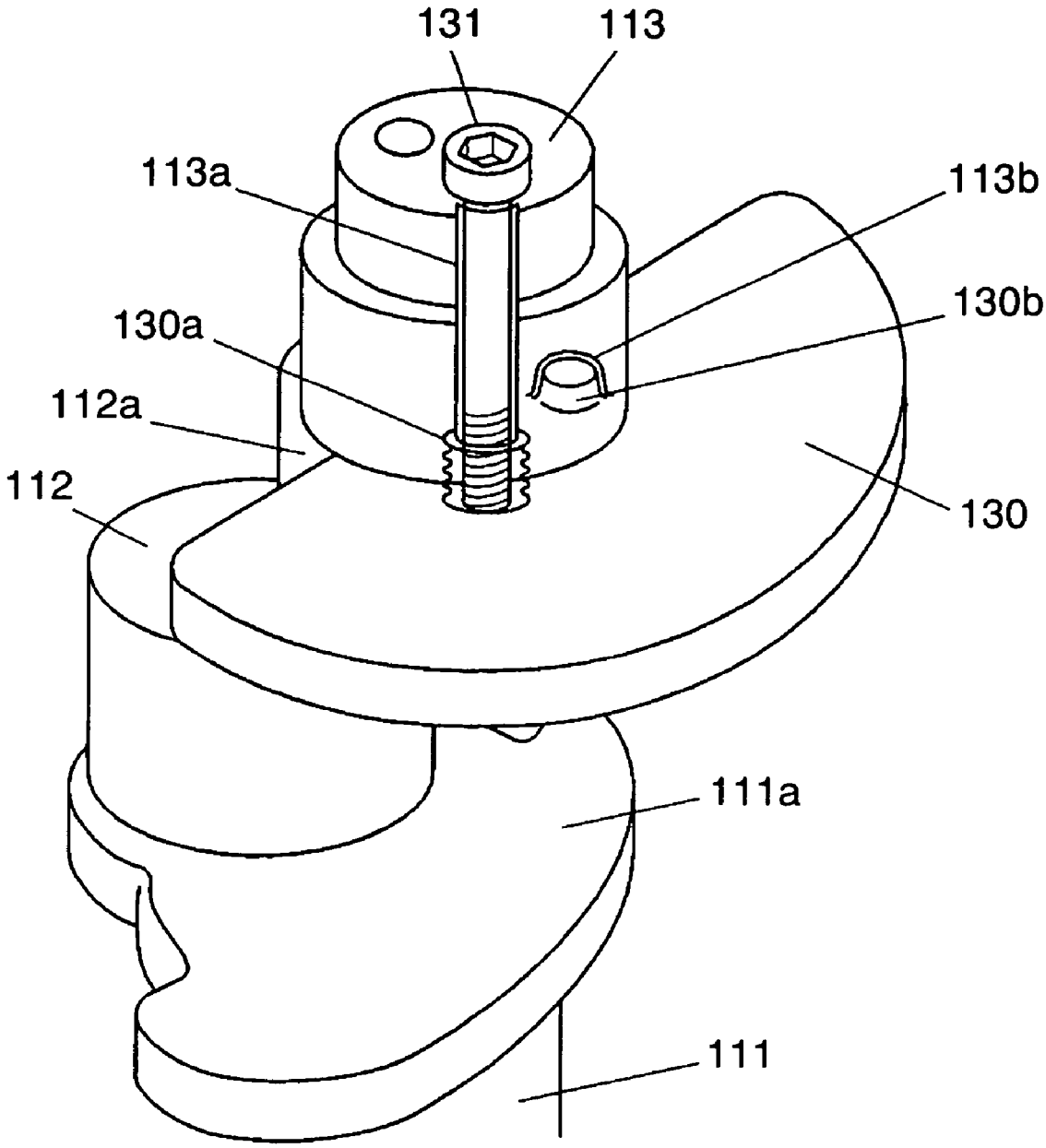
FIG. 4 is a perspective view of main part of the hermetic compressor according to the embodiment 1.
Figure 5:
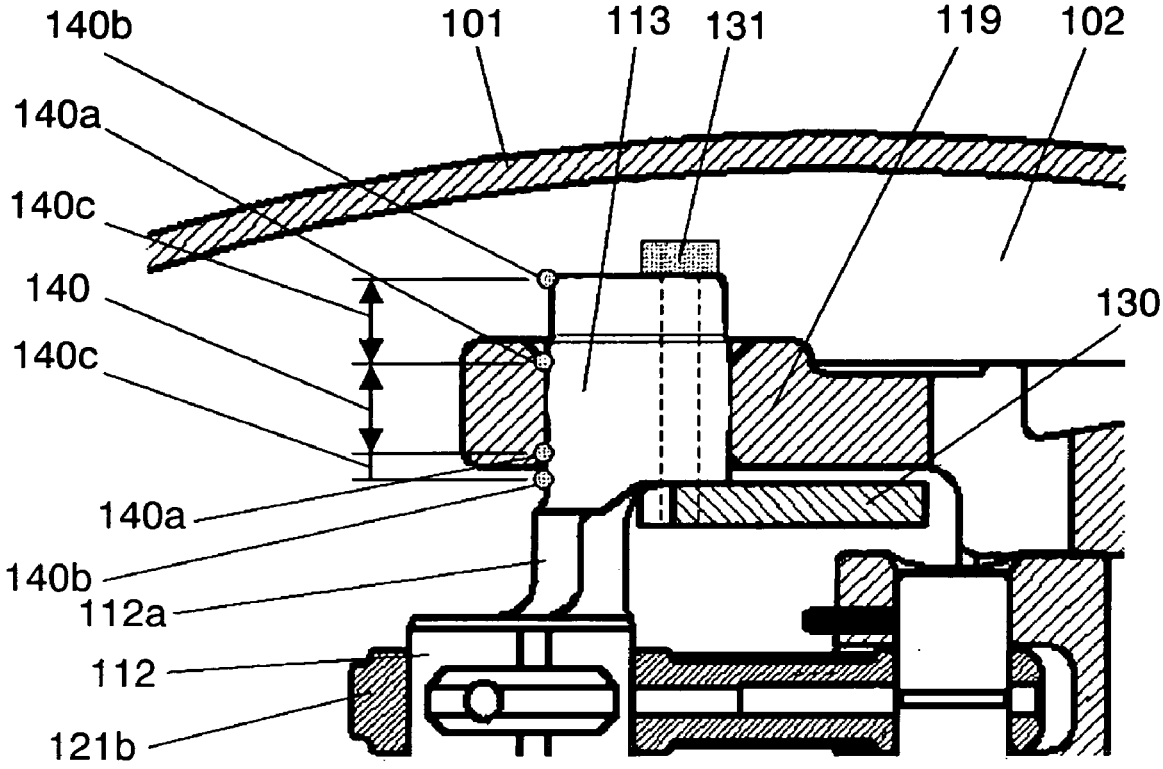
FIG. 5 is a sectional view of main part of the hermetic compressor according to the embodiment 1.

FIG. 1 is a vertical sectional view of the hermetic compressor according to preferred embodiment 1 of the present invention. FIG. 2 is a sectional plan view of the same embodiment. FIG. 3 is an expanded view of main part of the embodiment. FIG. 4 is a perspective view of main part of the same embodiment. FIG. 5 is a sectional view of main part of the same embodiment.

In FIG. 1 to FIG. 5, the closed vessel 101 is filled with a refrigerant 102. The electric driving element 105 is composed of a stator 103 having a coil portion 103*a* and a rotor 104. The compressing element 106 driven by the electric driving element 105 and the electric driving element 105 are elastically stored in the closed vessel 101 by means of suspension spring 107.

The shaft 110 has (i) a spindle portion 111 in which is press fit and fixed the rotor 104, (ii) an eccentric shaft portion 112 formed in eccentricity against the spindle portion 111, (iii) a second balance weight 111*a* formed integrally with the shaft 110 on the eccentric shaft portion 112 side of the spindle portion 111, (iv) an auxiliary shaft portion 113 provided coaxially with the spindle portion 111, and (v) a joint portion 112*a* connecting between the eccentric shaft portion 112 and the auxiliary shaft portion 113. On the auxiliary shaft portion 113 a through hole 113*a* passing in the axial direction and a concave part 113*b* are formed. On the first balance weight 130 a screw hole 130*a* and a convex part 130*b* are provided at positions corresponding to the through hole 113*a* and the concave part 113*b*, respectively. The first balance weight 130 is fixed to the auxiliary shaft portion 113, as the screw 131 is inserted from the counter-eccentric shaft side of the through hole 113*a* and connected with the screw hole 130*a*, after the concave part 113*b* and the convex part 130*b* are fit together.

The cylinder block 116 has an about cylindrical compression chamber 117, and has, overhead, an auxiliary bearing 119 supporting the auxiliary shaft portion 113. The main bearing 118 for supporting the spindle portion 111 is fixed to the lower part of the cylinder block 116 with a screw 123. The piston 120 is inserted in the compression chamber 117, in a way so as to freely slide reciprocatingly. The piston 120 and the eccentric shaft portion 112 are connected to each other, through a piston pin 122, by means of a connecting means 121 which is a connecting rod realized by integrally forming the large end portion 121*a* of the connecting means, the small end portion 121*b* of the connecting means and the connecting portion 121*c* connecting between them. The connecting means 121 is submitted to honing, to be worked into a ring shape having cylindricity and roundness of high accuracy together with the large end portion 121*a* and the small end portion 121*b*. Namely, a bar-shaped grindstone is incorporated in the mandrel at the respective holes, to provide rotational and reciprocating motions and work by face contact while pressurizing the inside diameter portion.

Still more, as shown in FIG. 5, the respective distances 140*c* between the two ends 140*a* of the sliding portion 140 and the two ends 140*b* of auxiliary shaft portion, of the auxiliary bearing 119 and the auxiliary shaft portion 113, are at least no less than ½ of the diameter of the through hole 113*a*.

An explanation will be made hereinafter of the assembling method of the hermetic compressor constructed as described above.

The piston 120 is integrated with the connecting means 121 by the piston pin 122, and is then inserted in the compression chamber 117 of the cylinder block 116. After the main bearing 118 is inserted in the spindle portion 111 of the shaft 110, the rotor 104 is press fit and fixed to the spindle portion 111. In this state, the shaft 110 is inserted first in the auxiliary shaft portion 113, and then in the large end portion 121*a* of the connecting means and the auxiliary bearing 119 in this order. Simultaneously as the auxiliary shaft portion 113 is inserted in the auxiliary bearing 119, the eccentric shaft portion 112 is inserted in the large end portion 121*a* of the connecting means. After that, the main bearing 118 is fixed to the cylinder block 116 with the screw 123.

After that, the convex part 130*b* of the first balance weight 130 is fit in the concave part 113*b* of the auxiliary shaft portion 113. And, as the screw 131 is inserted in the through hole 113*a* from above the auxiliary shaft portion 113 and connected with the screw hole 130*a*, the first balance weight 130 is screwed to the auxiliary shaft portion 113.

An explanation will be given hereinafter of the motions of the hermetic compressor constructed as above.

The shaft 110 turns with the rotor 104 of the electric driving element 105. As the rotational motion of the eccentric shaft portion 112 is transferred to the piston 120 through the connecting means 121, the piston 120 makes reciprocating motions in the compression chamber 117. With this motion, the refrigerant gas is sucked from the cooling system (not illustrated) into the compression chamber 117 and compressed there, and is then discharged back into the cooling system again.

On the occasion of this compressing action, a large reciprocating inertial force is produced on the piston 120. This reciprocating inertial force becomes the largest source of vibrations, and produces vibrations. These vibrations are transferred to the mechanical portion composed of the compressing element 106 and the electric driving element 105, and are transferred from the mechanical portion to the closed vessel 101 through the suspension spring 107. However, to reduce this reciprocating inertial force of the piston 120 as much as possible, the first balance weight 130 and the second balance weight 111*a* are provided for maintaining equilibrium in a way so as to be in opposite phase against the piston 120. Namely, when the piston 120 reaches the top dead point which is the final point of the compression process, the gravity center of the first balance weight 130 and the second balance weight 111*a* are positioned on the piston shaft center on the counter-piston side in the horizontal section. Moreover, when the piston 120 reaches the bottom dead point which is the final point of the suction process, the gravity center of the first balance weight 130 and the second balance weight 111*a* are positioned on the piston shaft center on the piston side in the horizontal section. As a result, the reciprocating inertial force of the piston 120 is offset in both the horizontal direction and the vertical direction.

Consequently, according to the construction of this preferred embodiment, it becomes possible to provide the first balance weight 130 and the second balance weight 111*a* by using a simple method of assembling, and to offset the reciprocating inertial force of the piston 120 in both the horizontal direction and the vertical direction, thus providing an effect of reducing noise and vibrations.

To provide the first balance weight 130 and the second balance weight 111*a*, one may conceive a method of splitting the large end portion 121*a* of the connecting means to assemble it. By this method, even if the accuracy of cylindricity and roundness of the large end portion 121*a* of the connecting means is improved before the assembling, a connecting work of the large end portion 121*a* of the connecting means is required in the assembling stage. A defect of this method is that it is very difficult to control the accuracy on the micrometer level, at the time of this connecting work. However, according to the construction of this preferred embodiment, it is possible to integrally form the connecting means 121 and perform the assembling in the state in which the accuracy of cylindricity and roundness of the holes in the large end portion 121*a* of the connecting means is improved with honing, thus enabling to enhance the reliability of the compressor. For example, by integrally forming the connecting means 121, it becomes possible to control both cylindricity and roundness of the large end portion 121*a* of the connecting means at a level of 5 μm or under. By having such cylindricity and roundness of high accuracy, the construction of this preferred embodiment provides a high reliability in the sliding portion without metallic contact due to uneven contact even if it is subject to a large face pressure during the compression process.

Moreover, there exist a large number of compressors with different cubic capacities depending on the type of refrigerant and freezing capacity, and the diameter and weight, etc. of the piston 120 vary with the cubic capacity. Even in such case, the thickness and shape of the first balance weight 130 can be adjusted as desired, because it is constructed with a separate member. Namely, one obtains an effect of easily offsetting the reciprocating inertial force of the piston 120 even on compressors with different cubic capacities.

Furthermore, (i) the work of integrating the piston 120, the piston pin 122 and the connecting means 121, and (ii) the work of press fitting and fixing the rotor 104 and the shaft 110, which require long working hours, can be executed before the assembling of the compressor. For that reason, one obtains an effect of executing the line work in the manufacturing processes smoothly in a short time, improving the working efficiency.

Still more, because the screw 131 can be fastened from the counter-eccentric shaft portion side of the auxiliary shaft portion 113, one obtains an effect of good assembling workability, thus improving the working efficiency.

Yet more, with the construction positioning the auxiliary shaft portion 113 and the first balance weight 130 by means of fitting of concave part and convex part, it becomes possible to not only make the positioning easily at the time of assembling and to improve the working efficiency, but also to prevent the first balance weight 130 from being displaced with turning by centrifugal force during a compressor operation.

In addition, the distance 140*c* from the two ends 140*a* of the sliding portion 140 of the auxiliary shaft portion 113 and the auxiliary bearing 119 to the two ends 140*b* of the auxiliary shaft portion is at least no less than ½ of the diameter of the through hole 113*a*. The reason for it is the following.

For example, in the case where a screw 131 with a diameter of 3 mm generally called M3 is fastened to the auxiliary shaft portion with a diameter 16 mm at a proper torque, the compressive force acting on the auxiliary shaft portion 113 is 6 kN. The inner stress generated by this compressive force affects an area of 1 mm or so from the two ends 140*b* of the auxiliary shaft portion, namely a range of about ⅓ of the diameter of the screw 131. In this range, the auxiliary shaft portion 113 is deformed, and its cylindricity deteriorates. Since the inner stress generated by this compressive force is proportional to the screw diameter, it is also about proportional to the diameter of the through hole 113*a* provided depending on the screw diameter.

Therefore, by separating the sliding portion 140 from the two ends 140*b* of the auxiliary shaft portion by at least no less than ½ of the diameter of the through hole 113*a*, it becomes possible to maintain the clearance between the auxiliary shaft portion 113 and the auxiliary bearing 119 constant, without hardly any deformation up to the sliding portion 140, even if the auxiliary shaft portion 113 is deformed with fastening of the screw 131. Namely, because no metallic contact due to uneven contact is produced in the sliding portion 140, one obtains an effect of improving the reliability of the compressor, by preventing noise or unusual wear originating from metallic contact.

While, in this preferred embodiment, the screw 131 is presented as fastened to the screw hole 130*a* provided in the first balance weight 130, the screw 131 may also be inserted from the eccentric shaft portion 112 side of the through hole 113*a*, and then fastened by means of nut (not illustrated) from the counter-eccentric shaft portion side, to obtain a similar effect.

Preferred Embodiment 2

Figure 6:
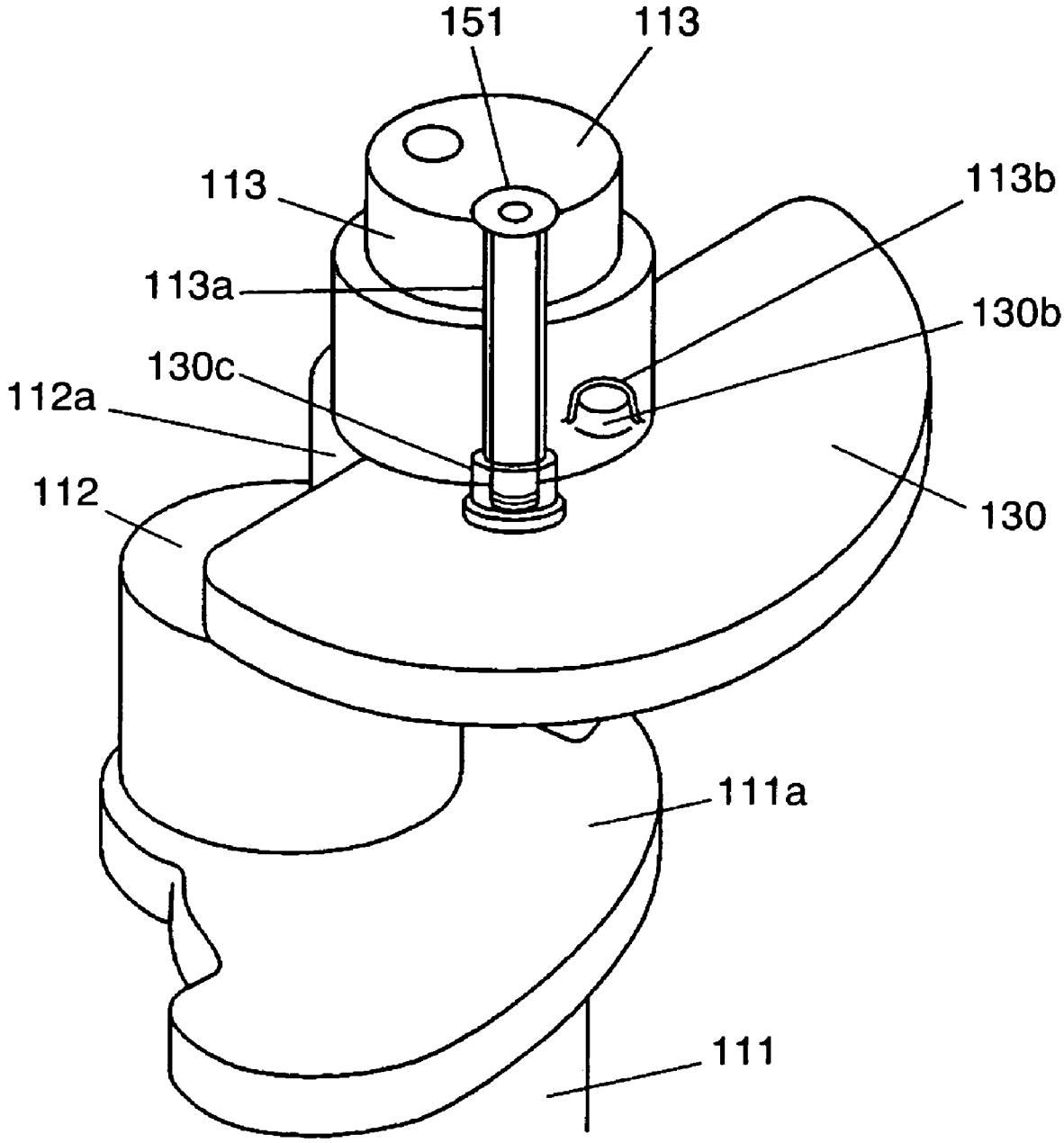
FIG. 6 is a perspective view of main part of the hermetic compressor according to preferred embodiment 2 of the present invention.
Figure 7:
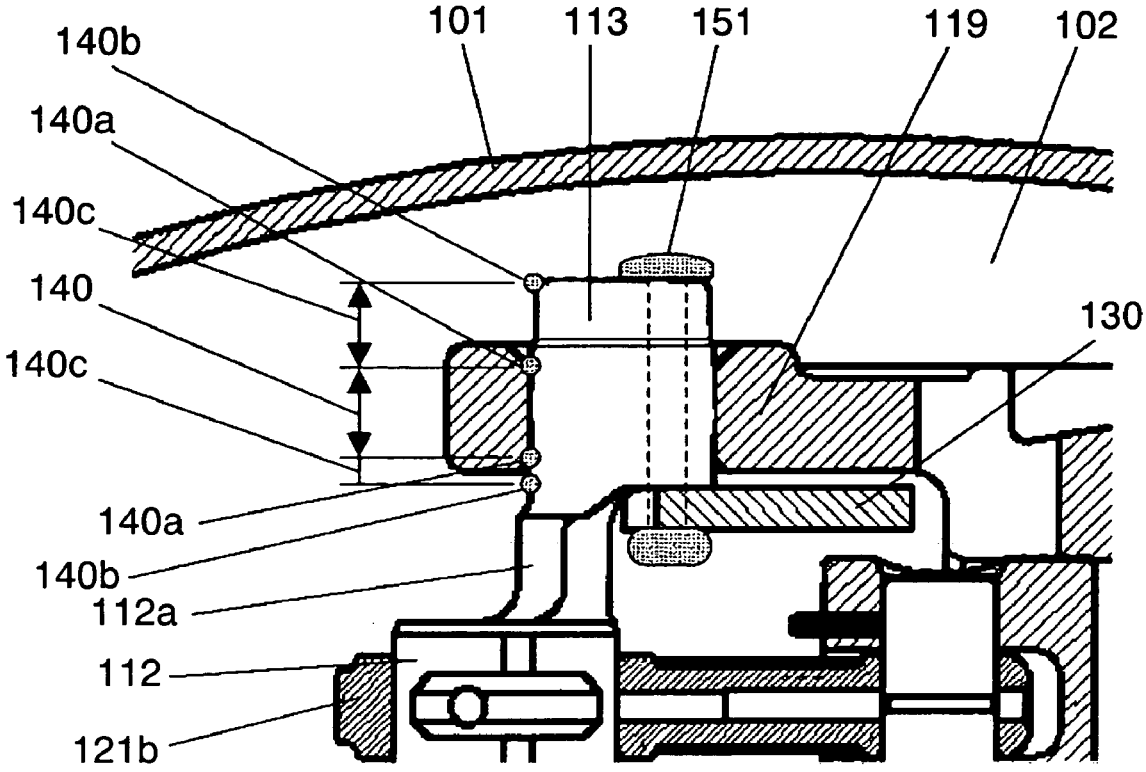
FIG. 7 is a sectional view of main part of the hermetic compressor according to the embodiment 2.
Figure 8:
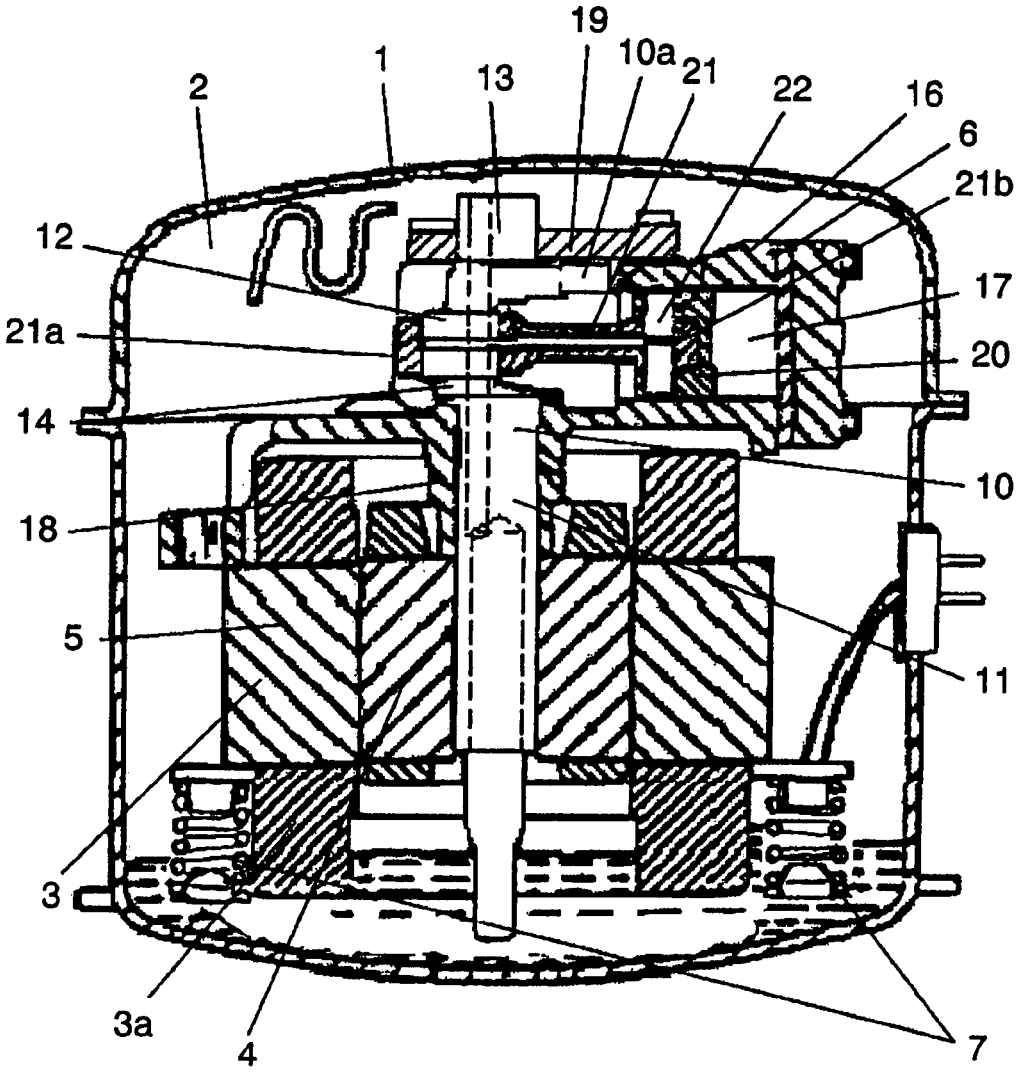
FIG. 8 PRIOR ART
FIG. 8 is a vertical sectional view of a conventional compressor.
Figure 9:
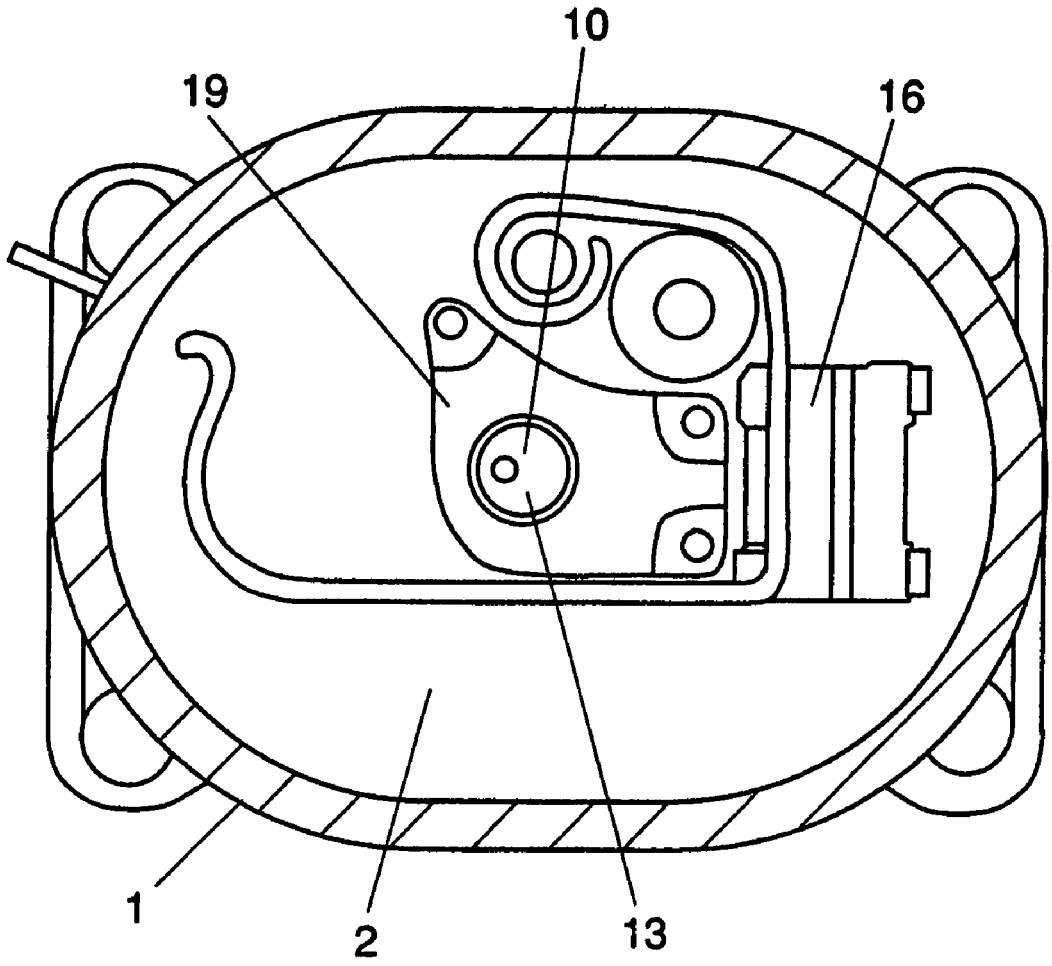
FIG. 9 PRIOR ART
FIG. 9 is a sectional plan view of a conventional compressor.

FIG. 6 is a perspective view of main part of the hermetic compressor according to preferred embodiment 2 of the present invention. FIG. 7 is a sectional view of main part of the hermetic compressor according to the embodiment 2.

The basic construction of the hermetic compressor in this preferred embodiment 2 is the same as the contents indicated in FIG. 1 to FIG. 5. Moreover, for constructions identical to those in the preferred embodiment 1, the same symbols will be used and detailed explanation will be omitted.

In FIG. 6 and FIG. 7, the fixing of the first balance weight 130 of the hermetic compressor to the auxiliary shaft portion 113 will be made by the method of caulking with a rivet 151.

Explanation will be given hereinafter on the assembling method of the hermetic compressor constructed as above.

The piston 120 is integrated with the connecting means 121 by the piston pin 122, and is then inserted in the compression chamber 117 of the cylinder block 116. After the main bearing 118 is inserted in the spindle portion 111 of the shaft 110, the rotor 104 is press fit and fixed to the spindle portion 111. In this state, the shaft 110 is inserted first in the auxiliary shaft portion 113, and then in the large end portion 121*a* of the connecting means and the auxiliary bearing 119 in this order. Simultaneously, as the auxiliary shaft portion 113 is inserted in the auxiliary bearing 119, the eccentric shaft portion 112 is inserted in the large end portion 121*a* of the connecting means. After that, the main bearing 118 is fixed to the cylinder block 116 with the screw 123.

After that, the convex part 130*b* of the first balance weight 130 is fit in the concave part 113*b*. And, as the rivet 151 is inserted in the through hole 113*a* and the through hole 113*c* and caulked, the first balance weight 130 is screwed to the auxiliary shaft portion 113. At that time, the rivet 151 is inserted in the through hole 113*a* and the through hole 113*c* from above the auxiliary shaft portion 113, and the shaft bar is extracted. As a result, the portion protruding below the first balance weight 130 is plastically deformed, to fix the auxiliary shaft portion 113 and the first balance weight 130 to each other.

Because the auxiliary shaft portion 113 and the first balance weight 130 can be fixed to each other by simply caulking them with the use of the rivet 151 as described above, one obtains effects of good assembling workability and improved working efficiency.

While, in this preferred embodiment, the caulking is made by extracting the rivet 151 from above the first balance weight 130, one may also fix the auxiliary shaft portion 113 and the first balance weight 130 to each other and obtain similar effects, also by applying a load from above the auxiliary shaft portion 113 and plastically deforming the portion protruding below the first balance weight 130, in the case where there is a sufficient space for inserting a jig below the first balance weight 130.

INDUSTRIAL APPLICABILITY

A compressor with little vibrations can be realized with easy assembling, by balancing the unbalancing force produced with reciprocating motions of a piston in both horizontal direction and vertical direction. Furthermore, even if the auxiliary shaft portion is somewhat deformed when the first balance weight is fixed to the auxiliary shaft portion, it does not affect the auxiliary shaft portion and the sliding portion of the auxiliary shaft portion, enabling to improve abrasion resistance of the sliding portion.

The invention claimed is:

1. A hermetic compressor comprising:

an electric driving element;

a compressing element driven by the electric driving element; and a closed vessel for housing the electric driving element and the compressing element, wherein the compressing element comprises:

a shaft having an eccentric shaft portion, a spindle portion provided at a bottom surface of the eccentric shaft portion, and an auxiliary shaft portion provided at a top surface of the eccentric shaft portion so as to be coaxial with the spindle portion;

a cylinder block provided with a compression chamber;

a main bearing provided on the cylinder block so as to support the spindle portion;

an auxiliary bearing provided on the cylinder block so as to support the auxiliary shaft portion;

a piston reciprocating in the compression chamber; and a connecting member for connecting the piston and the eccentric shaft portion;

wherein a first balance weight is provided on the auxiliary shaft portion at a top end of the eccentric shaft portion;

wherein a second balance weight is provided on the spindle portion at a bottom end of the eccentric shaft portion;

wherein the first balance weight is coupled to the auxiliary shaft portion by a separate member having a head portion and a base portion, the diameter of the base portion being smaller than the diameter of the head portion, the auxiliary shaft portion being provided with a hole through which the base portion passes, the separate member being arranged between the first balance weight and the auxiliary shaft portion so that the base portion is fixed with the first balance weight and the head portion is in contact with the auxiliary shaft portion; and wherein the auxiliary shaft portion and the first balance weight are provided with a concave part and a convex part, respectively, such that the concave part and the convex part fit together so as to position the first balance weight.

* * * * *